US006479754B1

(12) United States Patent
Muzslay

(10) Patent No.: US 6,479,754 B1
(45) Date of Patent: Nov. 12, 2002

(54) STRAIN RELIEF SYSTEM FOR ELECTRICAL CABLE

(75) Inventor: Steven Zoltan Muzslay, Huntington Beach, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 62 days.

(21) Appl. No.: 09/633,737

(22) Filed: Aug. 7, 2000

(51) Int. Cl.[7] ..... H01B 7/04

(52) U.S. Cl. ..... 174/135; 174/64; 174/65 G; 174/65 R; 174/140 R

(58) Field of Search ..... 174/135, 65 R, 174/65 G, 59, 70 C, 64, 73.1, 140 R, 75 C; 16/2.5; 200/DIG. 22; 439/460

(56) References Cited

U.S. PATENT DOCUMENTS

| | | | | |
|---|---|---|---|---|
| 3,860,316 A | 1/1975 | Hardesty | 339/91 |
| 3,951,501 A | 4/1976 | Bauerle et al. | 339/91 |
| 3,951,505 A | 4/1976 | Williams | 339/103 |
| 4,211,462 A | 7/1980 | Wolfhal | 339/103 |
| 5,033,976 A | 7/1991 | Sarian et al. | 439/467 |
| 5,066,243 A | 11/1991 | Nuesslein et al. | 439/460 |
| 5,545,054 A | 8/1996 | Benes et al. | 439/467 |
| 5,645,454 A | 7/1997 | Kosmala | 439/675 |
| 5,772,470 A | 6/1998 | Togashi | 439/582 |
| 5,879,190 A | 3/1999 | Maruyama et al. | 439/582 |

*Primary Examiner*—Dean A. Reichard
*Assistant Examiner*—W. David Walkenhorst
(74) *Attorney, Agent, or Firm*—Roger C. Turner

(57) ABSTRACT

A strain relief attachment (10) is provided for coupling to the combination of an electrical connector (12) and a cable (14, 90, 92) extending from the rear of the connector, to provide strain relief for the cable. The attachment includes a housing (40) having a through passage (46) and having a front housing portion (42) that receives the electrical connector and a rear housing portion (44) that passes the cable. The rear housing portion has a slot (102) on one side to enable the fixing of the cable by pressing sidewardly through the slot to press the cable against an opposite side of the housing rear portion. For large cables, a simple tie (106) wrapped tightly around the housing rear portion presses directly against the cable. For smaller cables, an insert (120) that is molded as part of the housing, slides through the slot and presses the cable against the opposite side of the housing, with a tie pressing the insert against the cable. The housing rear portion includes a first part (50) at one side that is fixed to the rest of the housing, and a second part (52) at the opposite side that is connected by a strap (60) to the rest of the housing. The housing is molded of polymer into a single integral item.

16 Claims, 4 Drawing Sheets

STRAIN RELIEF SYSTEM FOR ELECTRICAL CABLE

BACKGROUND OF THE INVENTION

An electrical connector such as a coaxial connector, has a front mating end and a rear end that is terminated to the front end of a coaxial cable. It is important to provide strain relief for the cable to avoid damage especially at the locations where the conductors of the cable are terminated to contacts of the connector. A strain relief attachment with a minimum number of separate parts, which could provide strain relief for a connector of predetermined size and cables of different diameters, would be of value.

SUMMARY OF THE INVENTION

In accordance with one embodiment of the present invention, a strain relief attachment is provided for coupling to the combination of an electrical connector and a cable extending from the rear of the connector, which is easily attached to the connector and cable to provide strain relief with a minimum is number of simple parts. The attachment includes a molded dielectric housing with a through passage having a front portion that receives the electrical connector and a rear portion that passes the cable. The rear housing portion has a slot extending through its wall at one side, with the slot leading to the cable. This enables a tie, wrapped around the rear portion of the housing, to press the cable firmly against the opposite side of the housing. For large cables, this can be accomplished by wrapping a tie around the rear housing portion, with the tie extending through the slot and directly pressing one side of the cable against the opposite side of the rear housing portion. For small cables, an insert of the attachment is used. The insert is connected by a strap to the rest of the housing, and the insert can be slid through the slot and against the cable, with a tie wrapped around the insert to cause the insert to press the cable against the opposite side of the rear housing portion.

The rear housing portion has a first part lying on a first side of the passage and fixed to the front portion of the housing, and has a second part that is pivotly coupled to the rest of the housing, as through a strap molded integrally with the housing. The second housing part is held in place by the tie that holds down the cable.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
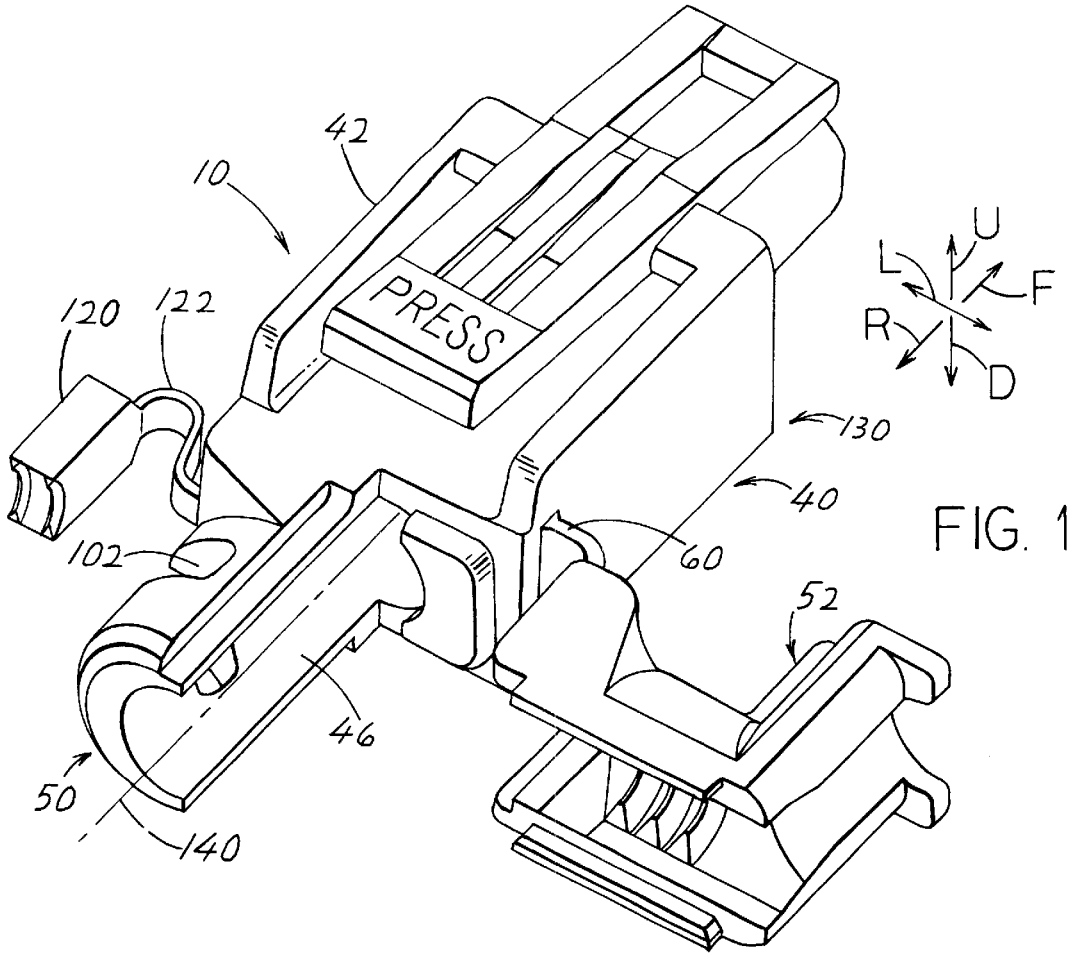
FIG. 1 is a rear and top isometric view of a strain relief attachment of the present invention, with the second part of the housing rear portion in its open position.
Figure 2:
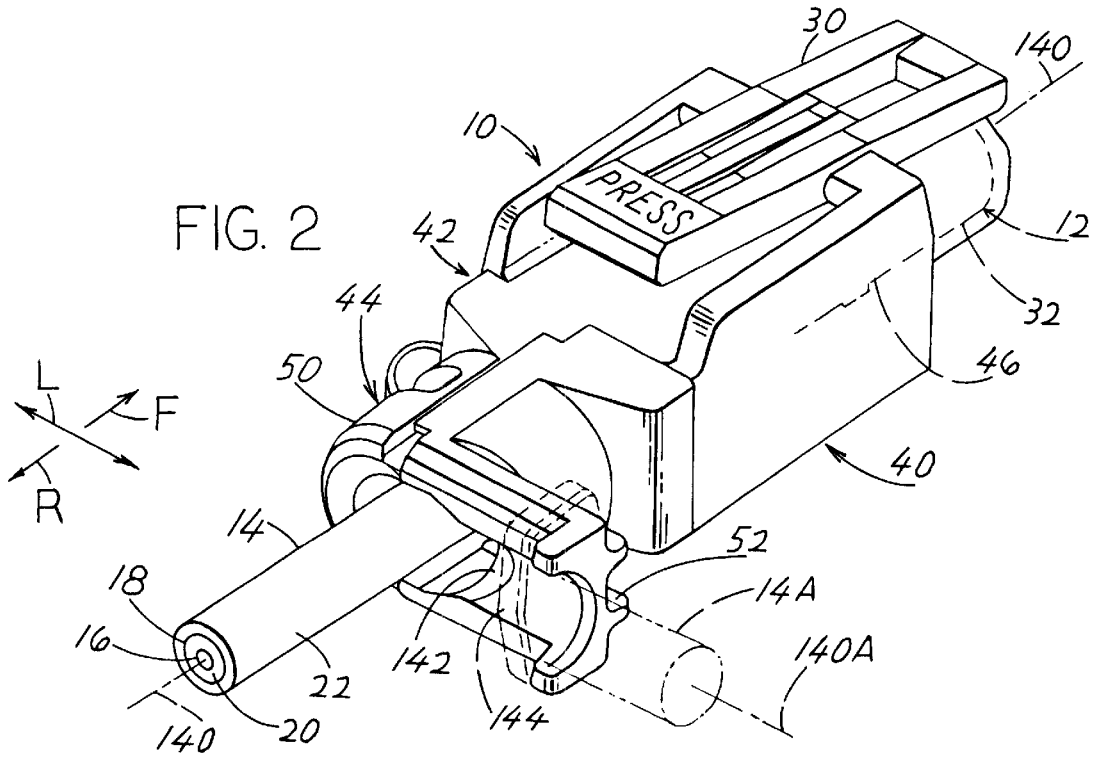
FIG. 2 is a view similar to that of FIG. 1, but with an electrical connector and cable mounted in the attachment, and with the second part of the housing rear portion in its closed position.

FIG. 2 illustrates an attachment 10 of the present invention, which is used with an electrical connector 12 and a cable 14 that extends rearwardly R from a rear end of the connector. The connector 12 is a coaxial connector, and to the cable 14 has inner and outer conductors 16, 18 separated by an inner insulator 20 and all surrounded by a jacket 22 of soft polymer material. It is noted that the attachment is useful for other types of connectors and cables. The attachment has a latch 30 for latching to a mating connector that mates with the front end 32 of the connector, and provides strain relief for the cable 14. The connector includes a housing 40 with front and rear portions 42, 44. The housing forms a passage 46 through which the connector and cable pass. The rear portion of the housing has laterally L spaced rear housing parts 50, 52. As shown in FIG. 1, the first housing part 50 is rigidly connected to the front portion 42 of the housing, while the second housing part 52 is pivotly connected through a strap 60 to the front housing part. When the second housing part 52 is moved away from the first part, as in FIG. 1, the electrical connector 12 with its cable, can be slid forwardly F through the passage 46 into position. Then, the second housing part 52 is pivoted closed against the first housing part 50 to clamp the cable 14 in position and provide strain relief for it.

Figure 6:
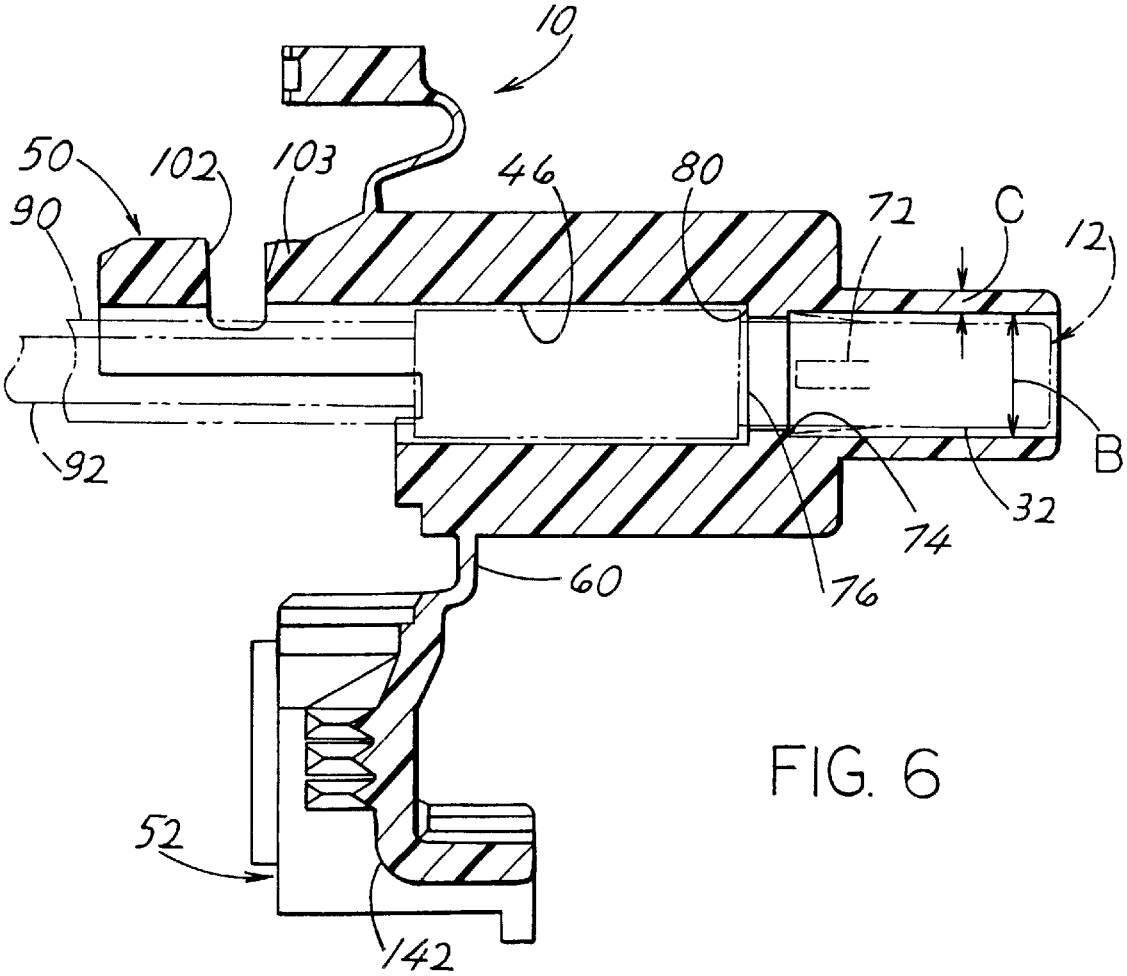
FIG. 6 is a sectional view of the attachment of FIG. 5, and showing a connector in place and two different sizes of cable in phantom lines.
Figure 7:
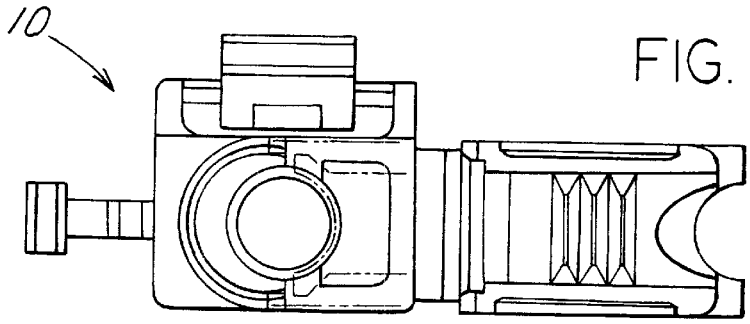
FIG. 7 is a rear elevation view of the attachment of FIG. 5, with the second part shown in an open position in solid lines, and shown in a closed position in phantom lines.

FIG. 6 shows that the front end 32 of the particular electrical connector 12 has tines 72 that abut a forwardly-facing shoulder 74 formed on the attachment 10, to prevent rearward movement of the electrical connector after it is pushed forwardly into place. A forwardly-facing shoulder 76 on the connector abuts a rearwardly-facing shoulder 80 on the attachment, to limit forward movement of the connector, thereby fixing the connector in the passage 46 of the attachment. Two sizes of cables are shown, including a large cable 90 and a small cable 92 that, extend rearwardly from the rear end of the connector (unless they are bent 90°).

Figure 8:
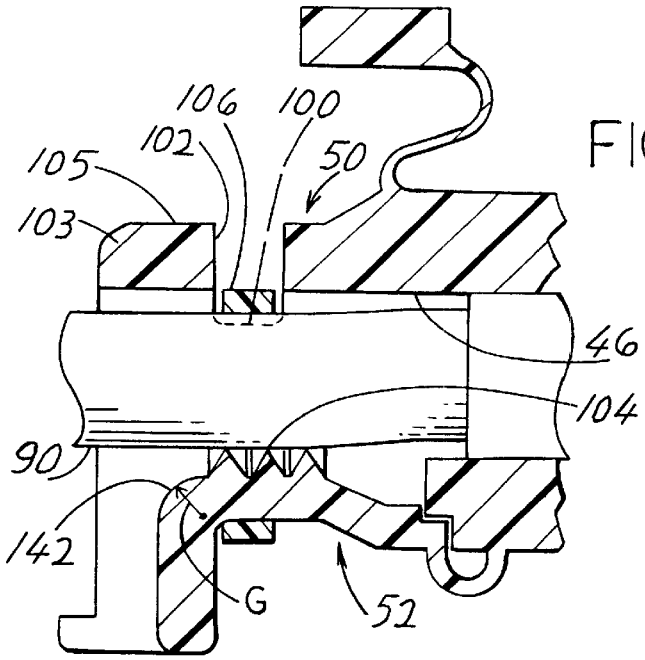
FIG. 8 is a partial sectional view of the attachment of FIG. 6, with a connector and large cable held in place.

After the connector has be latched in place, the second part 52 of the housing rear portion is pivoted to the closed position shown in FIG. 8. FIG. 8 shows a large diameter cable 90 which projects above the bottom 100 of a slot 102 in a wall 103 of the first part 50. The slot connects an outer surface 105 of the housing rear portion to the passage 46. The cable 90 is large so one side presses against a cable grip formed by projections 104 on the inside of the second part 52 while the opposite side of the cable projects above the bottom of the slot. In that case, a tie 106 is used which extends laterally through the slot 102, between laterally opposite slot sides 107, 108 (FIG. 4) and that directly presses one lateral side of the cable 90 (FIG. 8) against the projections 104 at the opposite side of the passage.

Figures 3, 4:
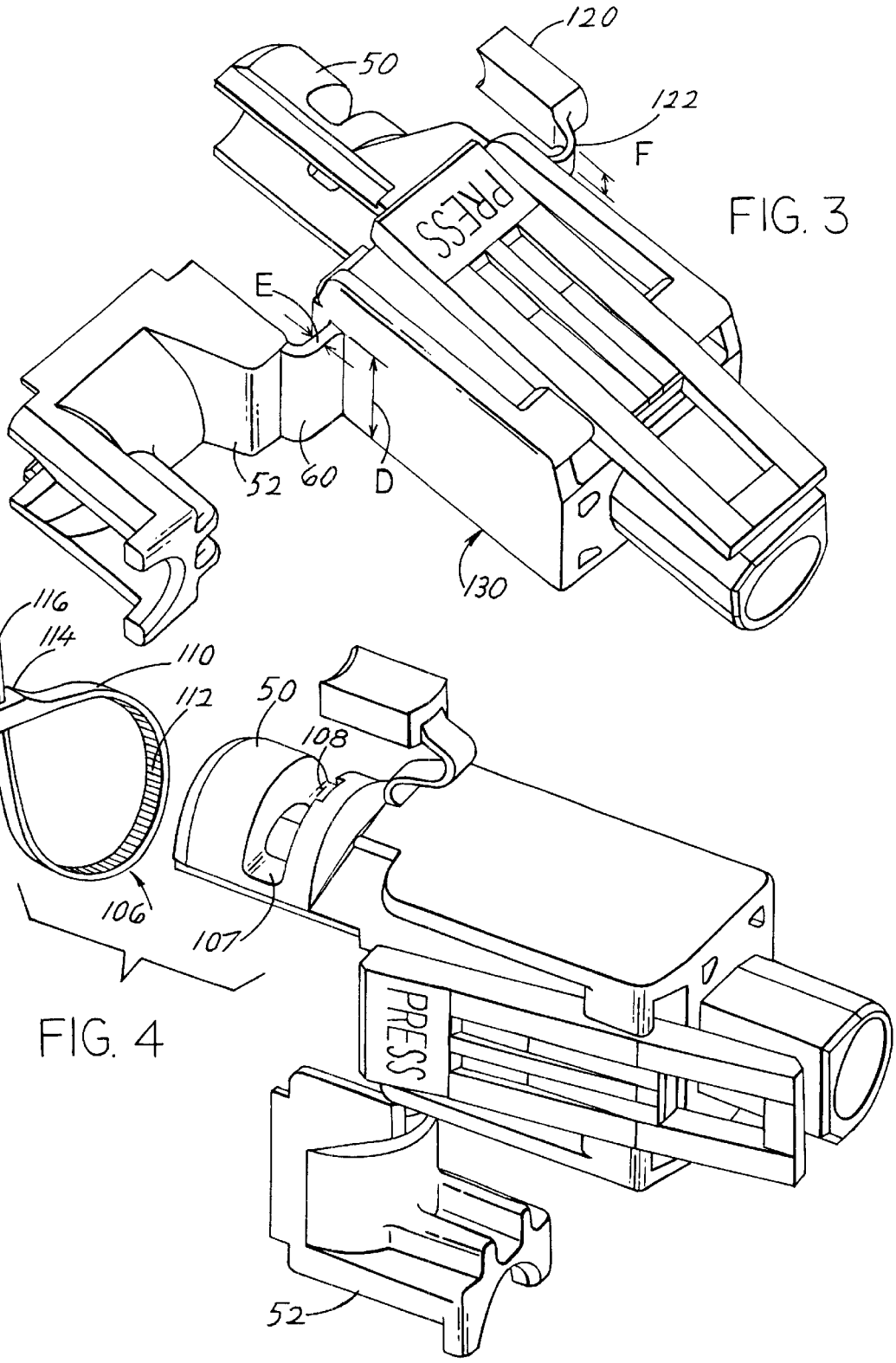
FIG. 3 is a front and top isometric view of the attachment of FIG. 1, with the second part of the housing rear portion in its open position.
FIG. 4 is a front and left side isometric view of the connector of FIG. 3, and also showing a tie that is used therewith.
Figure 5:
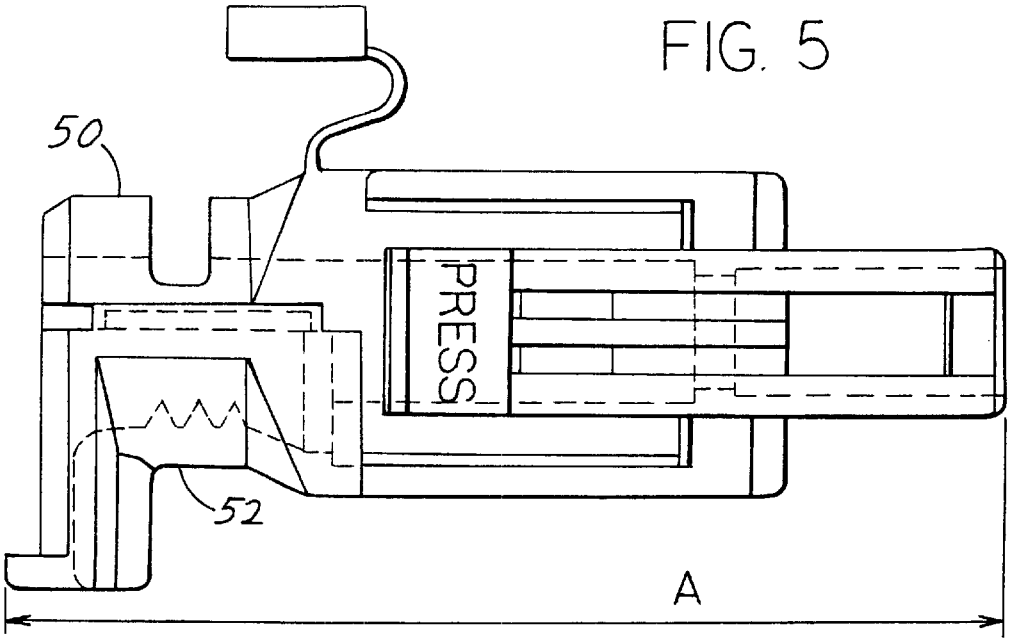
FIG. 5 is a plan view of the connector of FIG. 1, with the second part in its closed position.

FIG. 4 shows one type of tie 106 that can be used, which includes a flexible strap 110 with teeth 112 on its inside. One end of the strap merges with a latch 114 having a hole 116 through which the strap extends. The latch 114 has a finger (not shown) that engages a tooth 112 to prevent loosening of the tie when it is tightened (a tool can deflect the finger to remove the tie). This type of tie is well known and other types of ties with flexible straps (a strap is not necessarily wider than its thickness) can be used, as can a rubber band (not preferred).

Figure 9:
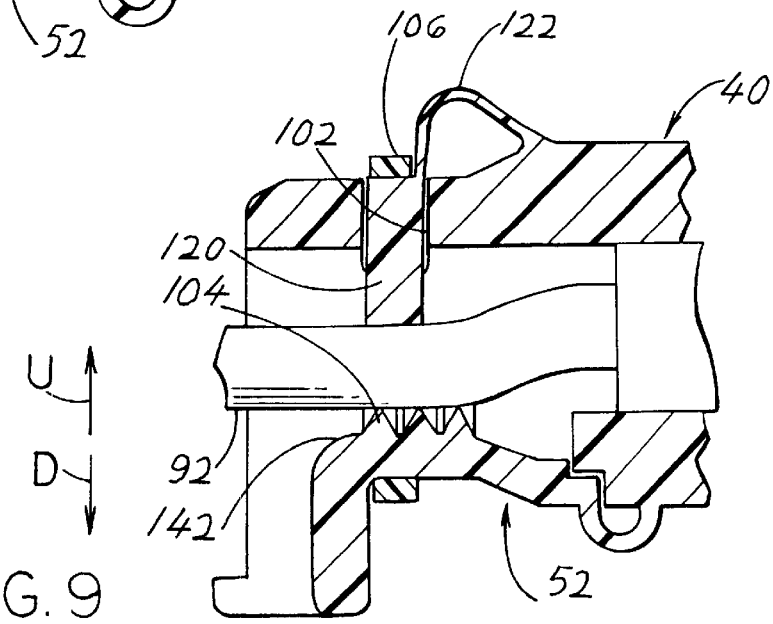
FIG. 9 is a partial sectional view of the attachment of FIG. 8, with a connector and small cable held in place.

FIG. 9 is similar to that of FIG. 8, but shows a small diameter cable 92 in place, and shows the use of an insert 120 to hold the cable 92 against the opposite side of the housing at projections 104. The insert is inserted downward D through the slot 102 against the cable 92. The tie 106 now extends around the insert 120 and around the second part 52 of the housing rear portion to hold the cable and housing second part in place, with the tie directly pressing the insert against the cable. The insert 120 is connected to the rest of the housing by a strap 122. Both the insert 120 and strap 122 are integrally molded with the housing 40.

Referring to FIG. 1, the housing 40 is molded of a dielectric polymer that is preferably a nylon thermoplastic. A main or major portion 130 of the housing that includes the front portion 42 of the housing and the first part 50 of the housing rear portion, are fixed together so they cannot freely pivot or shift relative to each other as can the straps. One strap 60 connects the main portion to the second housing part 52 to allow it to pivot at least about 90 degrees and slightly shift position so as to press against the first part 50. The second strap 122 which connects the main portion 130 to the insert 120 allows the insert to pivot by at least 90 degrees and shift while sliding into the slot. All of the housing parts including the straps and the parts 52, 120 that they hold, are integrally molded with the rest of the housing. This has the advantage that when the attachment is used, there are a minimum number of parts that have to be available, these being the attachment and a tie, in addition to the electrical connector and the cable it is terminated to.

In some situations, it is necessary to have the cable extend at about a right angle from the axis 140 of the passage. Such a cable is shown at 14A in FIG. 2 extending along axis 140A. This accomplished by bending the cable around a bend surface 142 on the second part 52. The bend surface has a radius of curvature G (FIG. 8) of at least one eighth the average diameter of the passage 46. After the cable is bent, a second tie 144 (FIG. 2) is wrapped around the portion of the cable that extends at about a right angle to the passage axis, and around the second housing part 52.

While terms such as "up", "down" are used, it should be understood that the attachment can be used in any orientation with respect to the Earth.

Applicant has made and tested an attachment of the construction shown in FIGS. 1–9. The attachment had an overall length A (FIG. 5) of 42.3 mm, a front passage portion having an inside diameter B (FIG. 6) of 5.38 mm, and a passage minimum wall thickness C of 0.9 mm. The strap 60 (FIG. 3) connecting the main portion 130 of the attachment to the second part 52 of the rear housing portion, had a width D of 8.06 mm and a thickness E of 0.78 mm. The strap 122 connecting the housing main portion 130 to the insert 120 had a width F of 1.87 mm and a thickness of 0.55 mm. The attachment can hold cables of an outside diameter between 2.3 mm and 5.1 mm.

Thus, the invention provides a strain relief attachment for coupling to the combination of an electrical connector and a cable extending from a connector, which facilitates assembly and which holds down a cable in a simple construction and with a minimum number of different parts. The attachment includes a housing with a passage for receiving the connector and cable. The housing has a rear portion with a slot extending through one side of the rear housing portion, where the slot leads to a cable lying in a rear passage portion. This enables a tie to apply pressure through the slot to press the cable against an opposite side of the rear housing portion. In some cases, the tie extends through the slot and directly against the cable. Applicant prefers to provide an insert that can be used with cables of small diameter, where the insert projects through the slot and a tie presses the insert against the cable. The second part of the housing rear portion is preferably pivotly coupled to the rest or main portion of the housing by a strap that permits the second part to be positioned out of the way during contact insertion and then pivot against the first part and shift position to accurately press against the first part. The tie that holds down the cable also holds together the first and second parts of the housing rear portion. The second part preferably forms a groove extending at a right angle to the passage to hold a cable that must extend to a right angle from the passage.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A strain relief attachment for mechanical coupling to the combination of an electrical connector and a cable extending from the connector, comprising:

a housing having a through passage, said housing having a front housing portion with a front passage portion for receiving the electrical connector and said housing having a rear housing portion with a rear passage portion for passing the cable;

said rear housing portion having a slot extending through a wall of the rear housing portion at one side thereof, with said slot leading to the cable in the rear passage portion to enable fixing of the cable position by pressing a cable retainer through the slot;

a tie that comprises said cable retainer and that includes a flexible elongated member that is wrapped about said rear housing portion and that extends through said slot and presses directly against the cable in the rear passage portion to press the cable against an opposite side of the passage.

2. The attachment described in claim 1 wherein:

said through passage has an axis that extends through said front and rear passage portions;

said housing is formed of a one-piece molded dielectric polymer, with said rear housing portion having a first part lying on a first side of said axis and rigidly fixed with respect to said housing front portion, and with said rear housing portion forming a second part lying on a second side of said axis, said housing forming a strap integral with said housing and said second part so said second part is moveable with respect to said first part between an open position away from said first part, and a closed position against said first part so said first and second parts surround the cable.

3. The attachment described in claim 2 wherein:

said tie wraps around said first and second parts to hold them together while applying force through said slot to hold the cable in place.

4. The combination of a strain relief attachment with an electrical connector and a cable, where the connector has a mating front end and the cable has a front end terminated to the connector, wherein:

said attachment forms a housing having a front housing end portion and a rear housing end portion, said housing forming a single cable-holding passage with a center axis and with a front passage portion and a rear passage portion, said cable passing through said rear passage portion;

said rear housing end portion has an outer surface, and has a slot on a first side of said axis which leads from said outer surface to said passage, and has a cable grip at a side of said passage axis opposite said slot;

a tie that is wrapped around said rear housing end portion at said slot to press said cable against said cable grip.

5. The combination described in claim 4 wherein:

said housing includes an insert that projects through said slot and that has an inner end lying directly against said cable and that has an outer end, with said tie lying in direct contact with said insert outer end and pressing said insert against said cable;

said housing is molded of a polymer and includes said insert and a flexible strap connecting said insert to the rest of said housing.

6. The combination described in claim 4 wherein:

said tie directly contacts said cable.

7. A strain relief attachment for mechanically coupling to the combination of an electrical connector and a cable extending from the connector, comprising:

a housing having a passage with an axis, said housing having a front housing portion with a front passage portion for receiving the electrical connector, and said housing having a rear housing portion with a rear passage portion for passing the cable;

said rear housing portion having laterally opposite sides and having a first part on a first lateral side that is fixed to said front housing portion with said first part and said front housing portion forming a major portion of said housing, and with said rear housing portion having a second part on a second lateral side of said rear housing portion with said second part being pivotally coupled to said major portion of said housing;

said housing is integrally molded of a dielectric polymer in one piece, with said second part being integral with said front housing portion and said first part of said rear housing portion.

8. The attachment described in claim 7 wherein:

said housing includes a strap extending between said second part and said rest of said housing, with said strap having a length and having a thickness less than said length.

9. The attachment described in claim 7 wherein:

said second part has a groove extending from a rear end of said passage, with said groove extending perpendicular to said axis of said passage when said second part is pressed against said first part, and with said groove merging with said passage in an inside surface having a radius of curvation that is at least one-fifth the average diameter of said passage.

10. The attachment described in claim 7 wherein:

said first part has a slot and said second part has at least one projection that projects toward the axis of the passage and that lies opposite said slot.

11. A method for use with a strain relief attachment that receives an electrical connector and a cable extending from a rear end of the electrical connector, comprising:

extending a tie around a rear portion of the attachment and around a cable location thereat including extending the tie through a slot in said rear portion, and tightening the tie to press one side of the cable against one side of said attachment that lies opposite the slot while the tie is prevented from falling off by walls of said slot.

12. The method described in claim 9 wherein:

said step of tightening said tie includes pressing said tie directly against one side of said cable.

13. A strain relief attachment for mechanical coupling to the combination of an electrical connector and a cable extending from the connector, comprising:

a housing having a through passage, said housing having a front housing portion with a front passage portion for receiving the electrical connector and said housing having a rear housing portion with a rear passage portion for passing the cable, said through passage having an axis extending through said front and rear passage portions;

said rear housing portion having a slot extending through a wall of the rear housing portion at one side thereof, with said slot leading to the cable in the rear passage portion to enable fixing of the cable position by pressing a cable retainer through the slot;

said through passage has an axis that extends through said front and rear passage portions;

said housing is formed of a one-piece molded dielectric polymer, with said rear housing portion having a first part lying on a first side of said axis and rigidly fixed with respect to said housing front portion, and with said rear housing portion forming a second part lying on a second side of said axis and moveable with respect to said first part between an open position away from said first part and a closed position against said first part so said first and second parts surround the cable;

said housing forms a strap connecting said housing front portion to said second part of said rear housing portion and integral with each of them.

14. A strain relief attachment for mechanical coupling to the combination of an electrical connector and a cable extending from the connector, comprising:

a housing having a through passage, said housing having a front housing portion with a front passage portion for receiving the electrical connector and said housing having a rear housing portion with a rear passage portion for passing the cable;

said rear housing portion having a slot extending through a wall of the rear housing portion at one side thereof, with said slot leading to the cable in the rear passage portion to enable fixing of the cable position by pressing a cable retainer through the slot, said front passage portion having an axis;

said rear housing portion has first and second parts, said second part being moveable against and away from said front part, said second part has perpendicular walls that form a groove that extends in a perpendicular direction to said axis when said second part lies against said first part, with said second part forming a recess to receive a tie that is wrapped about a bent cable portion lying in said groove and about said perpendicular wall.

15. A strain relief attachment for mechanical coupling to a cable that extends from a connector, comprising:

a housing having a through passage, said housing having a front housing portion with a front passage portion for receiving portions of the electrical connector and said housing having a rear housing portion with a rear passage portion for passing the cable, the rear passage portion having an axis extending along a center of the rear housing portion;

said rear housing portion having a slot extending through a wall of the rear housing portion at a first side thereof that is opposite a second side, with said slot leading to the cable in the rear passage portion to enable fixing of the cable position by pressing a cable retainer through the slot, said slot extending sufficiently around the rear passage portion that a flexible tie extending around the rear housing portion and through the slot will press a cable whose diameter equals the diameter of the rear passage portion, against said second side of said rear housing portion.

16. The attachment described in claim 15 including:

said tie includes a flexible elongated member that is wrapped about said rear housing portion and extends through said slot and presses directly against the cable in the rear passage portion to form said cable retainer.

* * * * *